US005957813A

United States Patent [19]

Macdonald

[11] Patent Number: 5,957,813

[45] Date of Patent: Sep. 28, 1999

[54] FINGER EXERCISE AND REHABILITATION DEVICE

[76] Inventor: John R. Macdonald, 1016 West Baltimore Pike, Suite E14, Media, Pa. 19063

[21] Appl. No.: 08/859,476

[22] Filed: May 20, 1997

[51] Int. Cl.[6] ..... A63B 23/16; A61F 5/37

[52] U.S. Cl. ..... 482/44; 482/47; 482/49; 482/91; 601/40; 128/879

[58] Field of Search ..... 482/44, 47, 49, 482/91; 601/40; 602/21, 22; 128/878–880; 5/647

[56] References Cited

U.S. PATENT DOCUMENTS

| | | | |
|---|---|---|---|
| 2,693,794 | 11/1954 | Neville | 128/878 |
| 3,756,222 | 9/1973 | Ketchum | 601/40 |
| 4,330,120 | 5/1982 | Netti . | |
| 4,585,228 | 4/1986 | Olson . | |
| 4,840,168 | 6/1989 | Lonardo . | |
| 5,029,573 | 7/1991 | Chow | 600/104 |
| 5,328,448 | 7/1994 | Gray, Sr. | 482/44 |
| 5,683,351 | 11/1997 | Kaiser et al. | 601/40 |

*Primary Examiner*—Richard J. Apley
*Assistant Examiner*—Victor K. Hwang
*Attorney, Agent, or Firm*—Massinger Law Office

[57] ABSTRACT

An apparatus for the therapeutic exercise and rehabilitation of injured fingers is comprised of a backboard upon which the dorsal side of the patient's hand is rested, a strap to secure the hand to the baseboard and provide necessary leverage for exercises and an immobilization bar which is used to anchor the proximal or middle phalanges to the backboard thereby isolating the proximal and distal interphalangeal joints, respectively, and their corresponding muscles for therapeutic exercise. The subject invention is designed for rehabilitation of both the left and right hand and includes means for adaptation to hands of various shape and size.

14 Claims, 5 Drawing Sheets

FINGER EXERCISE AND REHABILITATION DEVICE

FIELD OF THE INVENTION

The subject invention relates generally to a post traumatic rehabilitation device, and more specifically to such an apparatus for accelerated recovery of injured fingers.

BACKGROUND OF THE INVENTION

Traumatic injury to the hands and fingers, including deep lacerations to the palmer or gripping side thereof, occur with high incidence due to relatively excessive use and dependence on the hand for every day tasks. In short, the hand and fingers are extremely prone to injury which oftentimes result in diminished range of motion, strength and isotonic muscle contraction capability.

The subject invention provides a means for performing exercises for the active rehabilitation of injured fingers which were not completely incapacitated by injury or surgery. It is to be distinguished from those passive movement devices intended for those who have suffered a complete loss of finger movement and require external forces to accomplish the required physical therapy.

Heretofore, a plurality of exercise and rehabilitation devices for the hand and fingers have been developed. U.S. Pat. No. 5,445,582 issued Aug. 29, 1995 to Brown and U.S. Pat. No. 5,447,490 issued Sep. 5, 1995 to Fula, et al. teach recent developments in such hand and finger exercise devices and summarize the state of the relevant art as of 1995, summarizing a myriad of prior art references.

Despite the great variety of rehabilitative devices available, however, there remains a need for a device capable of providing the patient with a means of isolating each finger joint for the purpose of improving, through active exercises, the scope of their flexion and extension capabilities. Additionally, there remains a need for a device capable of providing a means for both isotonic and isometric finger contraction exercises for muscle and tendon rehabilitation. The above device should also accomplish these objectives without the attachment of peripheral devices to the digits themselves which may be sensitive and fragile after surgery.

SUMMARY OF THE INVENTION

The subject invention provides a finger exercise and rehabilitation device which effectively accomplishes those primary objectives described above and possesses numerous other advantages as set forth in the foregoing detailed description of the preferred embodiment. The subject finger exercise and rehabilitation device is comprised generally of three primary components: a backboard upon which the back of the patient's hand is rested, a strap to secure the hand to the baseboard and provide necessary leverage for exercises and an immobilization bar which is used to anchor specific areas of the digits to the backboard thereby isolating the desired finger joints and corresponding muscles and tendons for therapeutic exercise.

The backboard is designed for rehabilitation of both the left and right hand. More specifically, the shape of the backboard is such that one side roughly conforms to the shape of the left hand while the reverse side, a mirror image of the first side, conforms to the shape of the right hand. In other words, the backboard is reversible. Additionally, the subject device includes means for adapting to hands of various shape and size. To accomplish this, the angle of the immobilization bar relative to the underlying hand may be adjusted to fit the natural curve and alignment of the finger joints such that the bar may be adjusted latitudinally and/or horizontally, as needed, until properly oriented over the desired part of the digits. To accomplish this, the backboard includes immobilization bar adjustment means comprising columns situated on both the radial and ulnar sides of the backboard, each adapted with a plurality of adjustment foramina through which screws which support the immobilization bar are placed. Depending upon which foramina are selected on each side of the backboard, the desired angle can be achieved. The immobilization bar adjustment means also make it possible to adjust the height of the bar above the backboard for accommodation of fingers of various thickness.

The length of the immobilization bar itself has a gentle arch shape which conforms to the generally arched alignment of the joints of the fingers. This shape makes it possible for the immobilization bar to anchor the same portion of each digit to the backboard, thereby isolating the joint above the bar for therapeutic exercise as more fully described herein. The immobilization bar is further designed with digit separation means in the form of undulations or "peaks and valleys" which separate and comfortably cradle each finger.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is, therefore, a primary object of the subject invention to provide a rehabilitation device for fingers recovering from surgeries, broken bones, strains and torn muscles, tendons and ligaments.

Another object of the subject invention is to provide such a rehabilitative device providing a means for improving range of motion of finger joints and improved strength through both isotonic and isometric exercise of isolated portions of the fingers.

It is also an object of the present invention to provide a finger exercise and rehabilitation device which is portable and may be used by the patient both at home and at therapy.

It is another object of the present invention to provide a finger exercise and rehabilitation device which requires minimal instructions for use and, thus, may be used by the patient without professional assistance after proper training.

Still another object of the present invention is to provide a finger exercise and rehabilitation device for use by both left and right hands.

Another object of the present invention is to provide a finger exercise and rehabilitation device which, when worn by the user, does not impede wrist movement thereby reducing possible wrist fatigue attendant with more restrictive therapeutic devices.

Yet another object of the present invention is to provide a finger exercise and rehabilitation device which is durable and relatively simple and inexpensive to manufacture.

These together with other objects of the invention, along with the various features of novelty which characterize the invention, are pointed out with particularity in the claims annexed to and forming a part of this disclosure. For a better understanding of the invention, its advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENT

In order to best understand the construction, operation, objects and advantages of the subject finger exercise and rehabilitation device, it is first helpful to review relevant hand and finger anatomy and terminology used to locate anatomical structures. The portion of the hand nearest the wrist is the proximal end. Similarly, the portion of the fingers closest to the wrist is the proximal end. The portion of the fingers furthest away from the wrist is referred to as the distal end. The portion of the hand on the thumb side is referred to as the radial side, and the portion of the hand away from the thumb is the ulnar side. The front or palm side of the hand is the palmer side. The back of the hand is called the dorsal side.

Starting from the distal portion of the hand and moving outward, the first bone of each finger are the proximal phalanges designated "PP", the second bone of the fingers are the middle phalanges "MP" and the last bone of each finger are the distal phalanges "DP". The joint connecting the distal end of the hand with the proximal phalanges is referred to as the metacarpophalangeal joint "MPJ". The second joint of the fingers connecting the proximal phalanges to the middle phalanges is the proximal interphalangeal joint "PIPJ". The third and last joint of the fingers connecting the middle phalanges with the distal phalanges is referred to as the distal interphalangeal joint "DIPJ".

Figure 1:
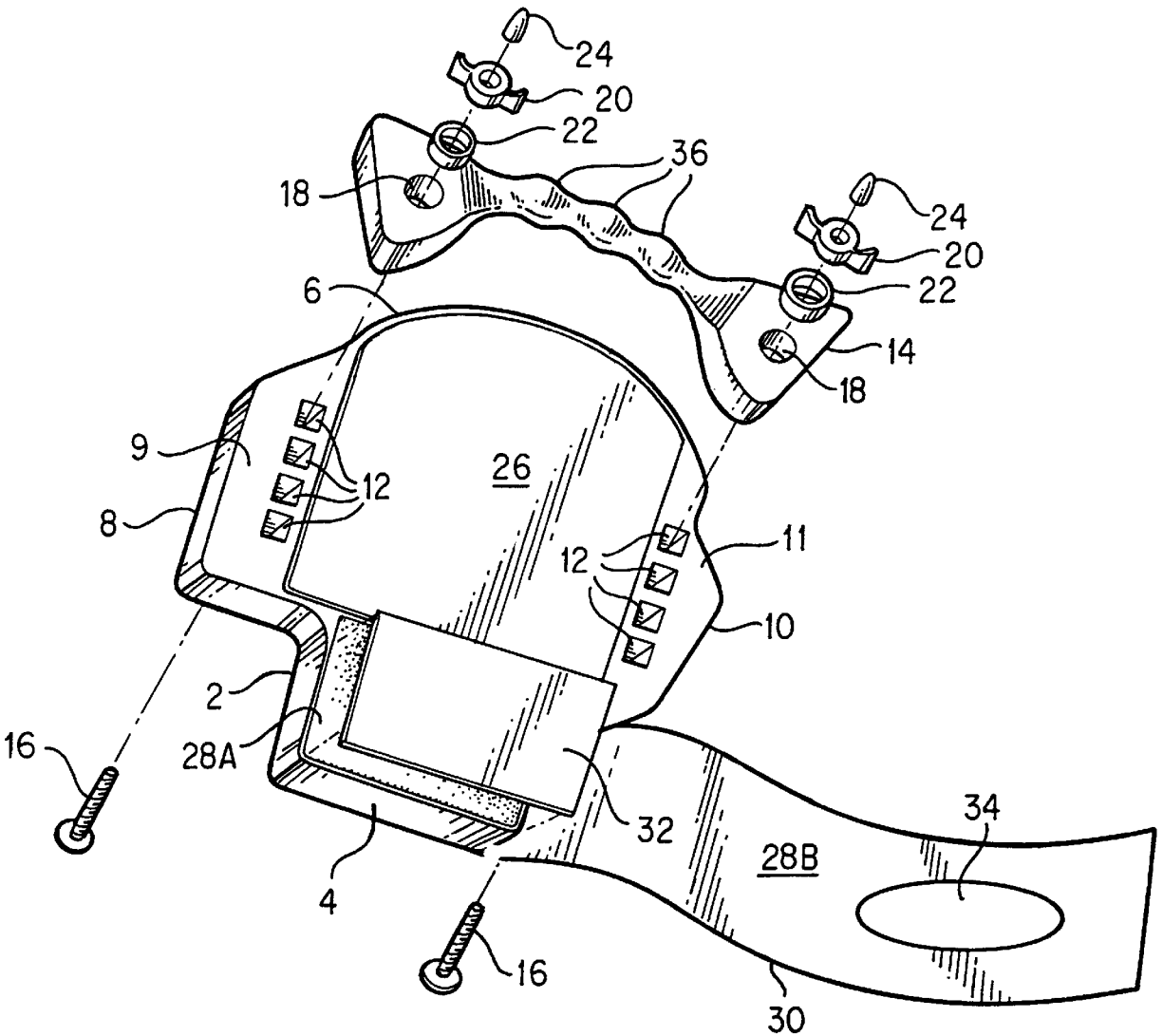
FIG. 1 is an exploded view of the subject finger exercise and rehabilitation device configured for left hand use.
Figure 2:
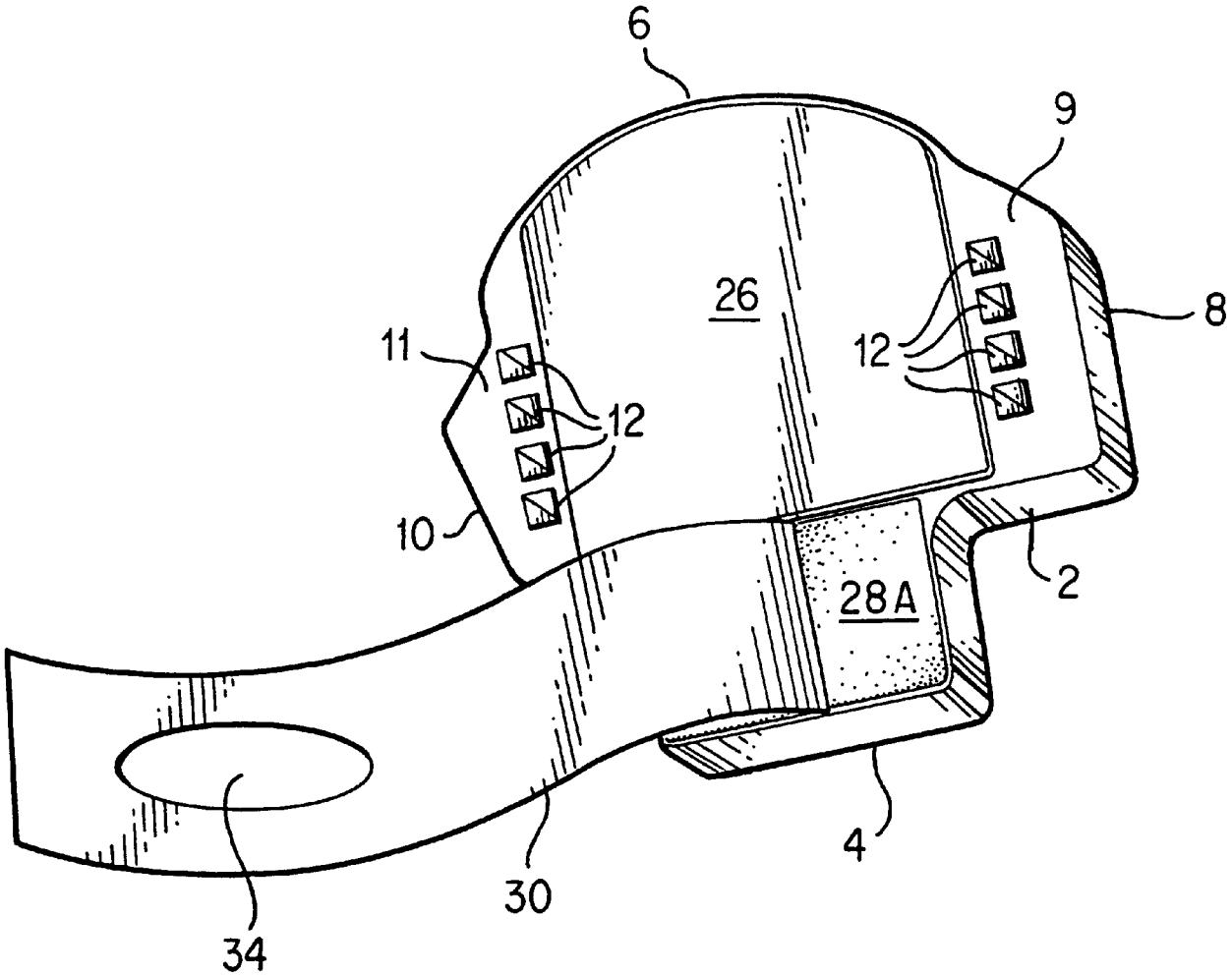
FIG. 2 is a rear perspective view of the invention of FIG. 1.

Reference is now made to FIG. 1 in which there is illustrated an exploded perspective view of the preferred embodiment of the subject finger exercise and rehabilitation device, comprised generally of three primary components: a backboard 2, a strap 30 and immobilization bar 14. Backboard 2 is of generally planar design and may be fabricated of any material having requisite strength, rigidity and light weight properties. Designed for exercise and rehabilitation of the fingers of both left and right hands, the shape of backboard 2 is such that one side roughly conforms to the shape of the left hand while the reverse side, a mirror image of the first side, conforms to the shape of the right hand (see FIG. 2). This reversible feature of backboard 2 and the subject invention as a whole is more cost effective for physical therapists or doctors who use the device in practice and for patient who require rehabilitation of the fingers of both hands.

Backboard 2 itself is comprised of four separate regions: proximal end 4, distal end 6, radial side 8 and ulnar side 10. Distal end 6 terminates at the hand-wrist point of union and does not extend beyond the distal end of the dorsal hand surface when worn. It is important to note that the subject apparatus as a whole does not involve attachment to or involvement of the wrist, a practice which is undesirable since restriction of wrist movement often results in fatigue of both wrist and hand during exercise. Radial side 8 and ulnar side 10 each terminate in adjustment columns 9 and 11, respectively, which in turn include a plurality of incrementally spaced adjustment foramina 12. Threaded and self seating adjustment screws 16 are inserted through the desired adjustment foramina 12 from the dorsal side of backboard 2 for the purpose of slidably receiving immobilization bar 14. Immobilization bar 14 is adapted with two apertures 18 for this purpose. Once immobilization bar 14 is slidably mounted above the palmer face of backboard 2, reciprocally threaded wing nuts 20 and spacers 22 are added to limit the degree of travel of immobilization bar 14 above backboard 2 to adjust for fingers of different size. Semi-elastic caps 24 add safety to the otherwise jagged edges of screws 16 and prevent wing nuts 20 from becoming dislodged.

Figure 3:
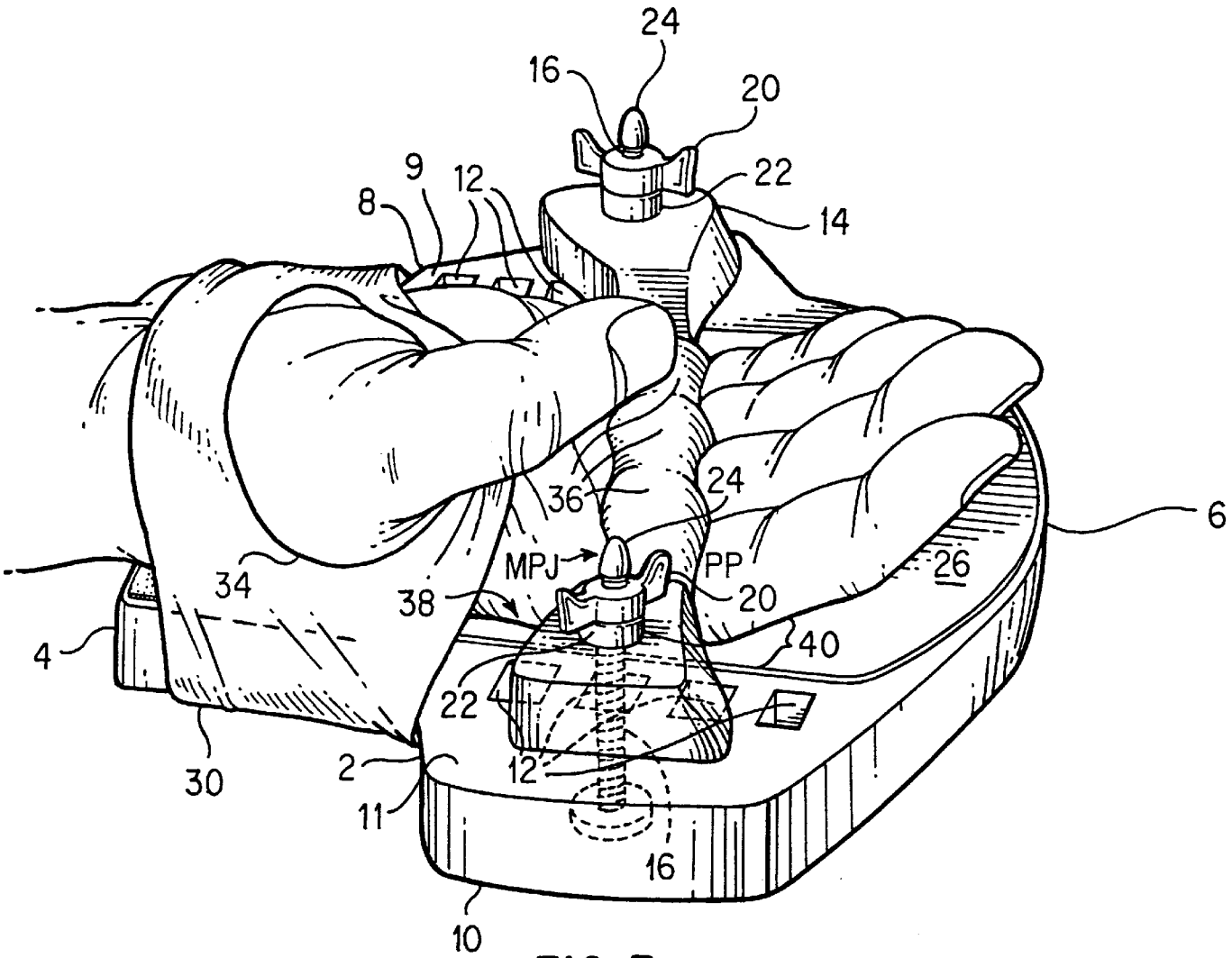
FIG. 3 is perspective view of the subject apparatus as applied to a human hand.

Both dorsal and palmer sides of backboard 2 are modified with a self-adhesive, closed-cell padding 26. Padding 26 is water resistant, resists absorption of odors, perspiration and bacteria and provides a comfortable surface against which the user's hand will lie during therapy. A ⅛ inch minimum thickness is preferred. Similarly, the hook portion 28A of hook and loop tape is fixedly attached to both dorsal and palmer sides of the distal end 4 of backboard 2. Strap 30, which is approximately 12 inches in length, is fabricated from a cloth-like material modified on one side with the loop portion 28B of hook and loop tape. In a manner which should be obvious, each end of strap 30 may be removably attached to the hook portion 28A of hook and loop tape found on the distal end 4 of the dorsal side (FIG. 2) of backboard 2 for purposes of securing the user's hand to the apparatus (as seen in FIG. 3). A removable pad 32 may be applied over the typically abrasive hook portion 28A of hook and loop tape on the palmer side of backboard 2 to provide additional comfort to the user during use.

Reference now being made to FIG. 3, the subject apparatus may be observed as applied to a human hand (right hand in this case). As may be readily observed, the dorsal side of the hand is situate against the closed-cell foam 26 which is fixedly attached to the palmer side of backboard 2. Strap 30 is wrapped around the distal portion of the hand with the thumb protruding through thumb aperture 34 of strap 30 thereby securing the hand to the backboard. The user's fingers are inserted under immobilization bar 14, the length of which is gently curved or arched to conform to the generally arched alignment of the joints of the fingers when oriented side by side. This shape makes it possible for the immobilization bar to anchor the same portion of each digit to the backboard, thereby isolating the joint above the bar for therapeutic exercise as more fully described below. The immobilization bar is further designed with digit separation means 36 in the form of undulations or "peaks and valleys" which separate and comfortably cradle each finger. Wing nuts 20 are then rotated until immobilization bar 14 rests gently over the desired portion of the digits. As may be appreciated, the length of screws 16 should be sufficient to accommodate fingers which are of relatively large diameter below immobilization bar 14. Those skilled in the art will no doubt recognize other means of carrying out vertical adjustment of the immobilization bar relative to the backboard 2 without departing from the spirit of the subject invention.

Figure 4:
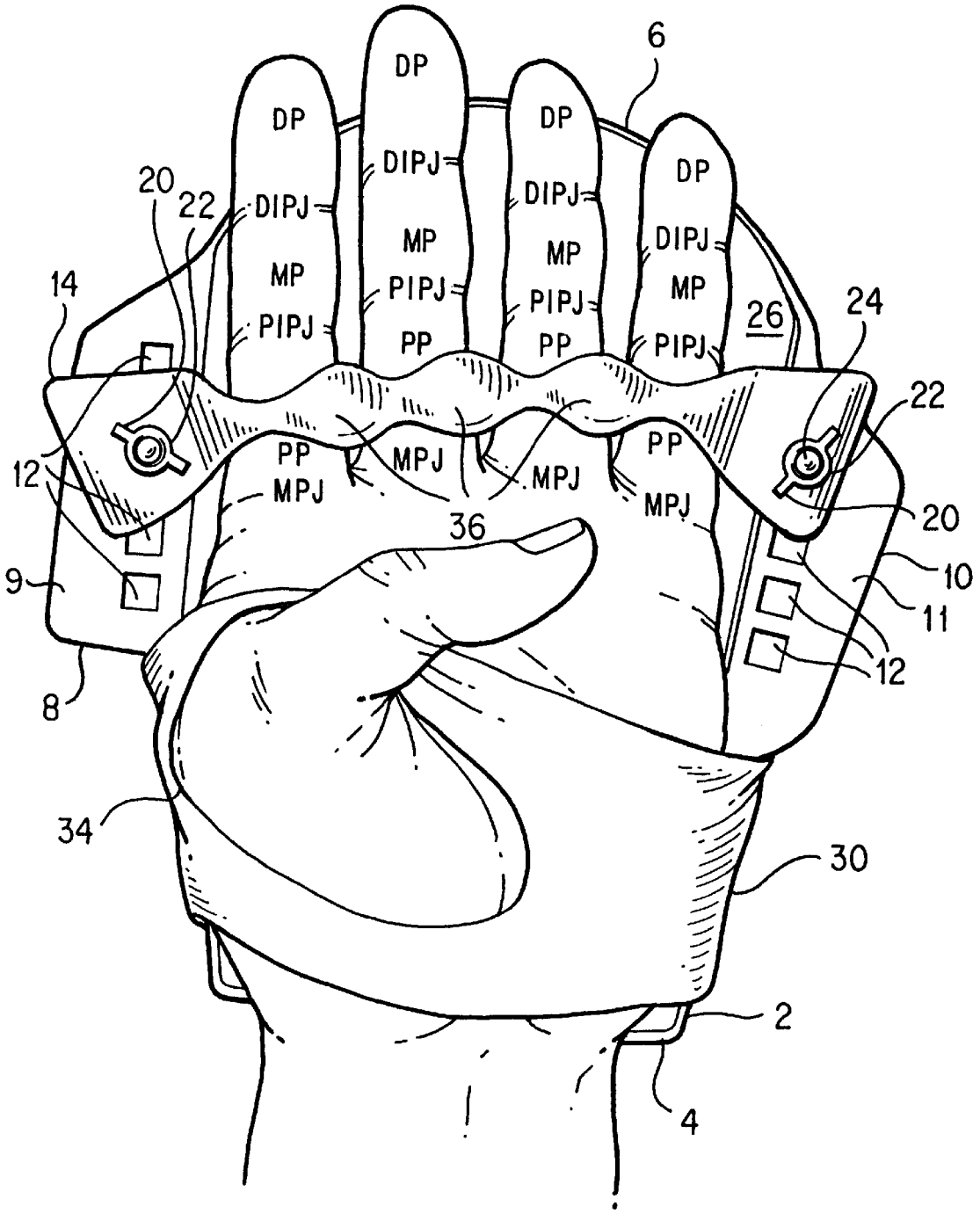
FIG. 4 is a plan view of the subject invention configured for isolation and exercise of the proximal interphalangeal joints as accomplished by immobilization of the proximal phalanges (finger joints extended)

Reference now being made to FIG. 4, it may be appreciated that the angle of the immobilization bar 14 relative to the underlying hand may be adjusted to fit the natural curve and alignment of the finger joints. This is accomplished through proper selection of adjustment foramina in the radial and ulnar columns 9 and 11, respectively, over which each end of immobilization bar will be mounted. In this fashion, immobilization bar 14 may be adjusted to the proper horizontal angle for a proper fit.

Method of Use

Figure 5:
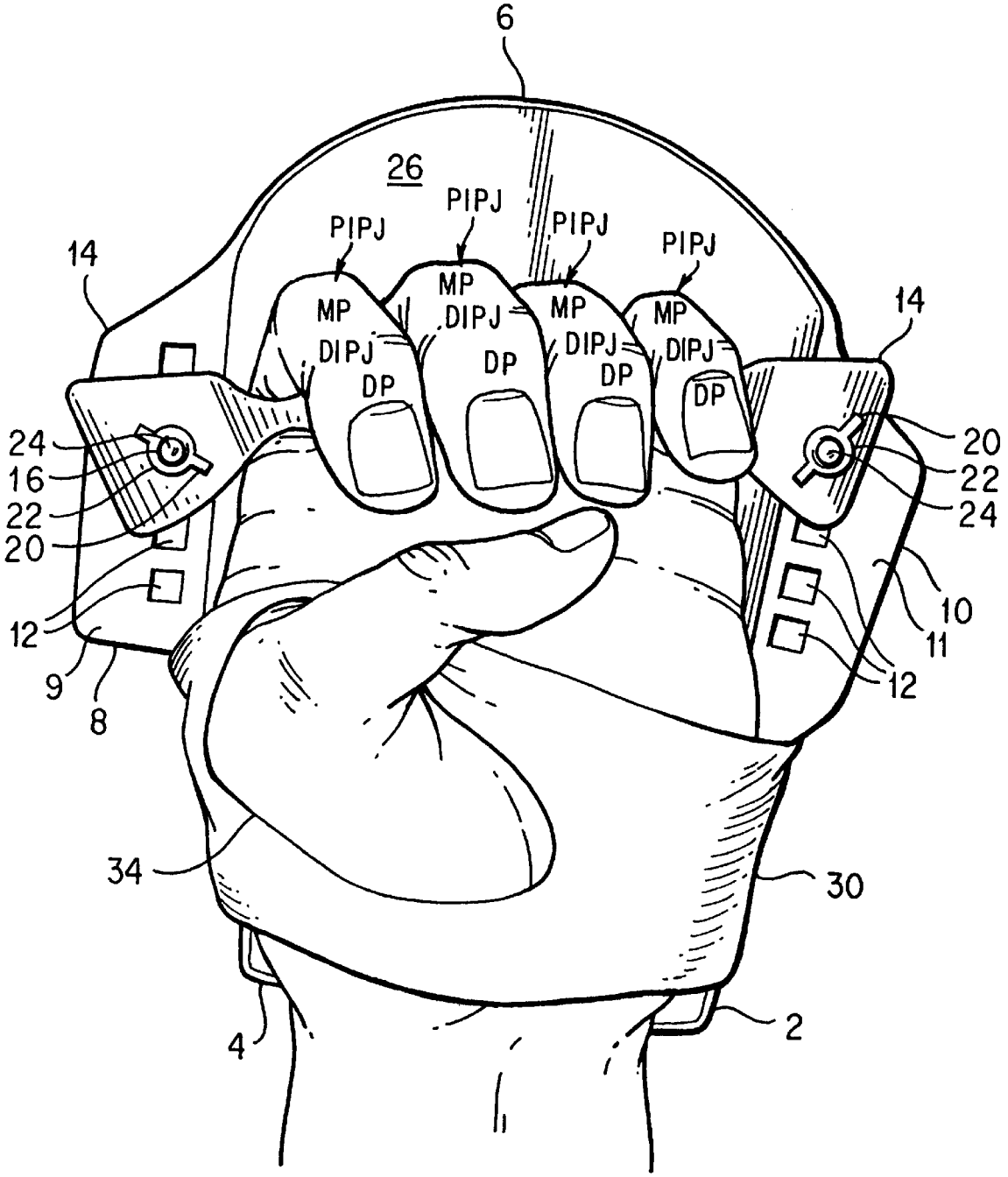
FIG. 5 is a plan view of the subject invention configured as in FIG. 4 (finger joints flexed).

With continued reference to FIG. 4 and additional reference to FIG. 5, the subject invention's method of use will be described. After the user's fingers have been inserted under immobilization bar 14 and the hand secured to backboard 2 using strap 30, immobilization bar 14 will be moved up or down along the proximal-distal axis of backboard 2 until the bar is situate over either the proximal phalanges as shown or over the middle phalanges (not shown). Once immobilization bar is in its proper position, it should be tightened gently over the fingers leaving a small degree of play or room for the fingers to move. Circulation should not be impeded. When immobilization bar 14 is placed over the proximal phalanges, it will be evident that portion of the fingers above the proximal phalanges is free to move for purposes of exercise. Specifically, anchoring of the proximal phalanges against backboard 2 in this fashion precludes movement of the metacarpophalangeal joint, but permits isotonic contraction of the proximal interphalangeal joint. Accordingly, as depicted in FIG. 4, the proximal interphalangeal joint may be actively extended by the patient to the degree possible and then flexed to the position depicted in FIG. 5 or as close thereto as possible given the patient's limitations on range of movement. By repeated flexion and extension of the proximal interphalangeal joint, isotonic contraction exercises are performed thereby strengthening and rehabilitating the muscles and tendons associated with that joint. The isotonic contraction, therefore, occurs in two phases: concentrically as the muscle shortens during proximal interphalangeal joint flexion (FIG. 4), and eccentrically as the muscles are lengthened during extension of the PIP joint (FIG. 5).

Of equal importance is the benefit received by the dorsal and palmer tendons of the fingers during these exercises. Rehabilitation of the fingers must often involve stretching of these tendons to increase the patient's lost range of motion resulting from trauma and subsequent surgery. Performance of the above exercises using the subject apparatus provides a means for improving both extension and flexion capabilities. Specifically, stretching of the dorsal tendons of the fingers is accomplished during the concentric contraction phase of the isotonic exercise, while stretching of the palmer tendons is accomplished during the eccentric contraction phase.

In addition to the isotonic exercises described above, the subject invention is also believed to provide a means for isometric exercise of the muscles associated with both the metacarpophalangeal joint and proximal interphalangeal joint. Referring once again to FIG. 3, it may be observed that the knuckles of the user's hand, designated here by reference numeral 38, rest firmly against the pad 26 of backboard 2. However, immobilization bar 14 is tightened to such a degree so as to permit a small degree of play or freedom of movement by the proximal phalanges away from the plane of the backboard. This degree of play is designated by reference numeral 40. Accordingly, isometric exercise of the muscles associated with the metacarpophalangeal joint is accomplished as the muscles exert force against the dorsal surface of immobilization bar 14, but without movement after contact is made and without change in muscle length.

Based on the above example, it should be readily appreciated that by positioning immobilization bar 14 over the middle phalanges, isolation of the distal interphalangeal joint may be accomplished for isotonic exercise of the muscles and stretching of the tendons associated therewith. Similarly, this placement of the immobilization bar will also provide a means for isometric contraction of the muscles associated with the proximal interphalangeal joint as force is exerted by the middle phalanges against the dorsal surface of immobilization bar 14.

Repeated exercise in conformity with the above protocol is intended to increase the patient's range of motion of the proximal and distal interphalangeal joints by stretching the dorsal and palmer tendons associated therewith while simultaneously improving muscle strength and condition.

Although the present invention has been described with reference to the particular embodiments herein set forth, it is understood that the present disclosure has been made only by way of example and that numerous changes in details of construction may be resorted to without departing from the spirit and scope of the invention. Thus, the scope of the invention should not be limited by the foregoing specifications, but rather only by the scope of the claims appended hereto.

What is claimed as being new, useful and desired to be protected by Letters Patent of the United States is as follows:

1. A portable finger exercise and rehabilitation device, comprising:

a) backboard having at least one surface, a first side and a second side; said at least one surface sized and configured such that a person's hand may be secured thereto; said first side and said second side each including a plurality of incrementally spaced adjustment foramina;

b) hand securing means for securing a person's hand to said backboard;

c) a first screw disposed through one of said plurality of adjustment foramina in said first side of said backboard;

d) a second screw disposed through one of said plurality of adjustment foramina in said second side of said backboard; and e) finger securing means for securing the proximal phalanges or the middle phalanges of a person's fingers to said at least one surface of said backboard; said finger securing means including an immobilization bar adjustably received along an axis of said first screw and an axis of said second screw for travel and for mounting at various heights above said at least one surface of said backboard; said immobilization bar extending from said first side to said second side of said backboard and curved to conform to the natural alignment of the proximal phalanges and middle phalanges of a person's fingers;

whereby alignment of said immobilization bar with respect to either the proximal phalanges or middle phalanges is accomplished through the selection of appropriate adjustment foramina through which said first screw and said second screw are disposed.

2. The portable finger exercise and rehabilitation device of claim 1 wherein said immobilization bar includes digit separation means; said separation means including undulations along a length of said immobilization bar.

3. The portable finger exercise and rehabilitation device of claim 1 wherein said hand securing means includes a strap; said strap including an aperture sized and configured to receive a person's thumb there through, and means for securing said strap to said backboard.

4. The portable finger exercise and rehabilitation device of claim 3 wherein said immobilization bar includes digit separation means; said separation means including undulations along a length of said immobilization bar.

5. A portable finger exercise and rehabilitation device, comprising:

a) a backboard having at least one surface sized and configured such that a person's hand may be secured thereto;

b) hand securing means for securing a person's hand to said backboard; said hand securing means including a strap; said strap including an aperture sized and configured to receive a person's thumb there through, and means for securing said strap to said backboard; and c) finger securing means for securing either the proximal phalanges or the middle phalanges of a person's fingers to said backboard; said finger securing means including an immobilization bar curved to conform to the natural alignment of the proximal phalanges and middle phalanges of a person's fingers and adjustably mounted to said backboard at a height above said at least one surface.

6. The portable finger exercise and rehabilitation device of claim 5 wherein said immobilization bar includes digit separation means; said separation means including undulations along a length of said immobilization bar.

7. The portable finger exercise and rehabilitation device of claim 5, further including vertical adjustment means for adjusting the height of said immobilization bar relative to said at least one surface of said backboard.

8. The portable finger exercise and rehabilitation device of claim 7, wherein said vertical adjustment means includes a first screw disposed through a first side of said backboard and a second screw disposed through a second side of said backboard such that said immobilization bar is adjustably received along an axis of said first screw and an axis of said second screw for travel and extends from said first side to said second side.

9. The portable finger exercise and rehabilitation device of claim 8 wherein said immobilization bar includes digit separation means; said separation means including undulations along a length of said immobilization bar.

10. The portable finger exercise and rehabilitation device of claim 7 wherein said immobilization bar includes digit separation means; said separation means including undulations along a length of said immobilization bar.

11. A portable finger exercise and rehabilitation device, comprising a planer backboard, a strap having opposite ends and an immobilization bar; said backboard having distal, proximal, radial and ulnar sides; said ulnar and radial sides each including a plurality of incrementally spaced adjustment foramina; the proximal side including means to removably receive each of said opposite ends of said strap to secure a user's hand to said backboard; a first screw is inserted through one of said adjustment foramina on said radial side of said backboard; a second screw is inserted through one of said adjustment foramina on said ulnar side of said backboard; and said immobilization bar is slidably and adjustably received along an axis of said first screw and an axis of said second screw for travel such that said immobilization bar extends from said radial side to said ulnar side.

12. The portable finger exercise and rehabilitation device of claim 11 wherein said immobilization bar is curved to conform to the natural alignment of the proximal phalanges and middle phalanges of a user's fingers.

13. The portable finger exercise and rehabilitation device of claim 12 wherein said immobilization bar includes digit separation means; said separation means including undulations along a length of said immobilization bar.

14. The portable finger exercise and rehabilitation device of claim 11 wherein said immobilization bar includes digit separation means; said separation means including undulations along a length of said immobilization bar.

* * * * *